US011072013B2

(12) United States Patent
Nakamura et al.

(10) Patent No.: US 11,072,013 B2
(45) Date of Patent: Jul. 27, 2021

(54) FORMED MATERIAL MANUFACTURING METHOD

(71) Applicant: NISSHIN STEEL CO., LTD., Tokyo (JP)

(72) Inventors: Naofumi Nakamura, Tokyo (JP); Yudai Yamamoto, Tokyo (JP)

(73) Assignee: NISSHIN STEEL CO., LTD., Tokyo (JP)

( * ) Notice: Subject to any disclaimer, the term of this patent is extended or adjusted under 35 U.S.C. 154(b) by 411 days.

(21) Appl. No.: 15/562,051

(22) PCT Filed: Mar. 15, 2016

(86) PCT No.: PCT/JP2016/058136
§ 371 (c)(1),
(2) Date: Sep. 27, 2017

(87) PCT Pub. No.: WO2016/158383
PCT Pub. Date: Oct. 6, 2016

(65) Prior Publication Data

US 2018/0099325 A1 Apr. 12, 2018

(30) Foreign Application Priority Data

Mar. 31, 2015 (JP) ..... JP2015-070609

(51) Int. Cl.
*B21D 22/28* (2006.01)

(52) U.S. Cl.
CPC ..... *B21D 22/28* (2013.01)

(58) Field of Classification Search
CPC ..... B21D 22/28; B21D 22/283; B21D 22/20; B21D 22/21; B21D 22/22; B21D 22/24;
(Continued)

(56) References Cited

U.S. PATENT DOCUMENTS 5,179,854 A * 1/1993 Matsui ..... B21D 22/28 72/349
5,209,099 A * 5/1993 Saunders ..... B21D 22/201 72/349
(Continued)

FOREIGN PATENT DOCUMENTS

JP 032575/1984 9/1985
JP S60-146526 U 9/1985
(Continued)

OTHER PUBLICATIONS

International Search Report cited in PCT/JP2016/058136 dated May 17, 2016, 2 pages.

*Primary Examiner* — Debra M Sullivan
*Assistant Examiner* — Matthew Kresse
(74) *Attorney, Agent, or Firm* — Rothwell, Figg, Ernst & Manbeck. P.C.

(57) ABSTRACT

A formed material 1 having a cylindrical trunk portion 10 and a flange portion 11 formed at an end section of the trunk portion is manufactured by performing multi-stage drawing of a material metal sheet. Multi-stage drawing includes: preliminary drawing that forms, from a material metal sheet 2, a preform 20 having a trunk element 20*a*; compression drawing that is performed at least once after the preliminary drawing and that forms the trunk portion 10 by drawing the trunk element 20*a* while applying a pressure-adjustable compressive force to the trunk element 20*a*; and finish-ironing that is performed for securing dimensional precision at least once following the compression drawing.

3 Claims, 9 Drawing Sheets

(58) Field of Classification Search
CPC ..... B21D 22/30; B21D 24/02; B21D 24/04; B21D 24/06; B21D 24/08; B21D 24/005; B21D 22/02; B21D 22/10; B21D 22/26; B21D 24/10; B21D 24/12; B21D 53/26; B21D 22/206; B21D 24/16; B21C 1/22
See application file for complete search history.

(56) References Cited

U.S. PATENT DOCUMENTS

| | | | | |
|---|---|---|---|---|
| 5,544,517 | A * | 8/1996 | Shimizu | B21D 22/28 72/347 |
| 2012/0282482 | A1 | 11/2012 | Flehmig et al. | |
| 2014/0182349 | A1* | 7/2014 | Yonemura | B21D 22/26 72/349 |
| 2015/0224563 | A1 | 8/2015 | Aso et al. | |
| 2016/0082495 | A1 | 3/2016 | Miyagi et al. | |
| 2016/0207085 | A1* | 7/2016 | Nakamura | B21C 1/22 |
| 2016/0339498 | A1* | 11/2016 | Nakamura | B21D 22/30 |

FOREIGN PATENT DOCUMENTS

| | | | |
|---|---|---|---|
| JP | 11-057914 | A | 3/1999 |
| JP | 2000-005827 | A | 1/2000 |
| JP | 2001-259750 | A | 9/2001 |
| JP | 2013-514185 | A | 4/2013 |
| TW | 201420230 | A | 6/2014 |
| TW | 201505734 | A | 2/2015 |

* cited by examiner

| ORDINARY WALL THINNING (COMPARATIVE EXAMPLE 1) | | | | | |
|---|---|---|---|---|---|
| THICKNESS OF MATERIAL METAL SHEET (mm) | THICKNESS BEFORE FINISH-IRONING (mm) | CLEARANCE (%) IN FINISH-IRONING | ROUNDNESS (mm) | PLATING RESIDUE | EVALUATION |
| 1 60 | 1. 42 | 9. 2 | 0. 30 | NONE | × |
| 1 65 | 1. 47 | 5. 4 | 0. 16 | NONE | × |
| 1. 70 | 1 51 | 2. 6 | 0. 10 | NONE | × |
| **1. 75** | **1. 56** | **−0. 6** | **0. 05** | NONE | ○ |
| **1. 80** | **1. 60** | **−3. 1** | **0. 04** | NONE | ○ |
| **1. 85** | **1. 64** | **−5. 5** | **0. 03** | NONE | ○ |
| **1. 90** | **1. 69** | **−8. 3** | **0. 02** | NONE | ○ |
| 1. 95 | 1. 74 | −10. 9 | 0. 02 | YES | × |

DIE SHOULDER RADIUS IN FINISH-IRONING:1.8mm

FIG. 11

| BOTTOMING WALL THICKENING (COMPARATIVE EXAMPLE 2) | | | | | |
|---|---|---|---|---|---|
| THICKNESS OF MATERIAL METAL SHEET (mm) | THICKNESS BEFORE FINISH-IRONING (mm) | CLEARANCE (%) IN FINISH-IRONING | ROUNDNES (mm) | PLATING RESIDUE | EVALUATION |
| 1. 60 | 1. 52 | 2. 0 | 0. 08 | NONE | × |
| 1. 65 | 1. 57 | −1. 3 | 0. 05 | NONE | ○ |
| 1. 70 | 1. 62 | −4. 3 | 0. 04 | NONE | ○ |
| 1. 75 | 1. 66 | −6. 6 | 0. 03 | NONE | ○ |
| 1. 80 | 1. 71 | −9. 4 | 0. 02 | NONE | ○ |
| 1. 85 | 1. 76 | −11. 9 | 0. 02 | YES | × |
| 1. 90 | 1. 81 | −14. 4 | 0. 02 | YES | × |
| 1. 95 | 1. 85 | −16. 2 | 0. 02 | YES | × |

DIE SHOULDER RADIUS IN FINISH-IRONING:1.8mm

FIG. 12

| WALL THICKENING CONTROLLED BY LIFTER FORCE (EXAMPLE OF THE PRESENT INVENTION) | | | | | | |
|---|---|---|---|---|---|---|
| THICKNESS OF MATERIAL METAL SHEET (mm) | THICKNESS BEFORE FINISH-IRONING (mm) | CLEARANCE (%) IN FINISH-IRONING | ROUNDNESS (mm) | PLATING RESIDUE | EVALUATION | LIFTER PAD FORCE |
| 1. 60 | 1. 65 | −6. 1 | 0. 03 | NONE | ○ | APPLIED |
| 1. 65 | 1. 63 | −4. 9 | 0. 03 | NONE | ○ | APPLIED |
| 1. 70 | 1. 63 | −4. 9 | 0. 03 | NONE | ○ | APPLIED |
| 1. 75 | 1. 63 | −4. 9 | 0. 04 | NONE | ○ | APPLIED |
| 1. 80 | 1. 60 | −3. 1 | 0. 03 | NONE | ○ | NOT USED |
| 1. 85 | 1. 64 | −5. 5 | 0. 02 | NONE | ○ | NOT USED |
| 1. 90 | 1. 69 | −8. 3 | 0. 02 | NONE | ○ | NOT USED |
| 1. 95 | 1. 74 | −10. 9 | 0. 02 | YES | × | NOT USED |

DIE SHOULDER RADIUS IN FINISH-IRONING:1.8mm

FORMED MATERIAL MANUFACTURING METHOD

Cross Reference to Related Application

This application is a 35 U.S.C. 371 National Phase Entry Application from PCT/JP2016/058136, filed Mar. 15, 2016, which claims the benefit of Japanese Patent Application No. 2015-070609 filed on Mar. 31, 2015, the disclosures of which are incorporated herein in their entirety by reference.

TECHNICAL FIELD

The present invention relates to a formed material manufacturing method for manufacturing a formed material having a cylindrical trunk portion and a flange portion formed at an end section of the trunk portion.

BACKGROUND ART

A formed material having a cylindrical trunk portion and a flange portion that is formed at an end section of the trunk portion is manufactured by drawing as described, for example, in NPL 1 below. The trunk portion is formed through stretching of a material metal sheet by drawing. Accordingly, the thickness of the peripheral wall of the trunk portion is ordinarily smaller than the material thickness.

A formed material that is formed through drawing such as the above may be used in some instances as a motor case disclosed, for example, in PTL 1. The peripheral wall of the trunk portion can be expected in this case to exhibit performance as a shield material for preventing magnetic leakage to the exterior of the motor case. The peripheral wall is also expected to deliver performance as a back yoke of a stator, depending on the structure of the motor.

The thicker the peripheral wall, the better is the performance as a shield material or as a back yoke. When manufacturing a formed material through drawing, as described above, the thickness of the material metal sheet is selected to be larger than a predetermined thickness of a trunk portion peripheral wall, in anticipation of decreases in thickness in the trunk portion, in such a manner that there is obtained the predetermined thickness of the trunk portion peripheral wall. However, the thickness of the material metal sheet is not constant at all times, and varies within an allowable range of thickness referred to as thickness tolerance. The decrement in thickness during drawing varies, for example, on account of changes in the state of a forming die and on account of variability in material characteristics.

High-precision inner-diameter roundness may be required from the inner diameter of the motor case, in order to reduce motor vibration and noise. To that end, inner-diameter roundness is ordinarily enhanced through finish-ironing of the trunk portion, in a step that is performed once multi-stage drawing is over. Finish-ironing is accomplished by ironing the material of the trunk portion, sandwiched from the inside and the outside by two forming dies having a clearance therebetween that is set to be smaller than the material thickness of the trunk portion. Such setting of the clearance to be smaller than the material thickness of the trunk portion is referred to as negative clearance.

When in this case the thickness of the material metal sheet is smaller than a planned thickness, or when a thickness reduction rate is large, on account of material characteristic variability in the material metal sheet or due to changes in the state of the forming die in a drawing step, the thickness of the trunk portion before ironing may become equal to or smaller than the planned thickness. The extent of ironing becomes then insufficient with the ironing forming die having been prepared beforehand, and inner-diameter roundness may decrease. When conversely the thickness of the material metal sheet is larger than the planned thickness or the thickness of the trunk portion before finish-ironing is excessively larger than the planned thickness due to, for example, changes in the state of the forming die during the drawing step or due to material characteristic variability, the inner-diameter roundness after finish-ironing is satisfied but other problems arise in that, for example, plating residue is generated that later on sloughs off the surface of the molded article, in cases where the surface of the material metal sheet is a surface-treated steel sheet having plating.

These problems derive from the fact that the thickness of the trunk portion peripheral wall before finish-ironing varies due to variations in the thickness of the material metal sheet and variations in the thickness reduction rate during drawing, whereas the clearance of the forming die for performing finish-ironing is fixed; as a result, variations in the thickness of the trunk portion peripheral wall before finish-ironing cannot be absorbed by modifying the drawing conditions.

Thus both a small and a large thickness of the trunk portion peripheral wall before finish-ironing are problematic in a case where a surface-treated steel sheet is used as the material metal sheet. Accordingly, a very strict tolerance is required from the thickness of the material metal sheet that is subjected to multi-stage drawing.

Such being the case, forming dies have been proposed in which compression drawing is performed in a multi-stage drawing step, as a way of for preventing thinning of the trunk portion of a drawn member, as described, for example, in PTL 2 below.

In this compression drawing forming die, a cylindrical member formed in a pre-process is fitted onto a deformation preventing member provided on a lower die, with an opening flange portion of the cylindrical member facing downward, and the opening flange portion is positioned in a recess of a plate provided on the lower die, whereby the outer periphery of the opening flange portion fits in the recess. The upper die is then lowered, to elicit press-fitting of a cylindrical portion of the cylindrical member into a die hole provided in the upper die, whereupon compression drawing is carried out through the action of the resulting compressive force.

Since the deformation preventing member can move vertically with respect to a plate, reductions in thickness are thus suppressed, and rather increases in thickness (wall thickening) are made possible, with virtually no tensile force acting on the side wall of the cylindrical member.

The compressive force acting on the trunk element in this case is equivalent to the deformation resistance of the trunk element at the time of press-fitting into the die hole. That is, factors contributing to increasing the thickness include mainly the forming die clearance between die and punch, a die shoulder radius and the material strength (proof strength×cross-sectional area) of the trunk element, all of which have a bearing on deformation resistance.

CITATION LIST

Non Patent Literature

[NPL 1] "Fundamentals of Plastic Forming", Masao MURAKAWA et al. (3), First Edition, Sangyo-Tosho Publishing Co. Ltd., Jan. 16, 1990, pp. 104 to 107

PATENT LITERATURE

[PTL 1] Japanese Patent Application Publication No. 2013-51765

[PTL 2] Japanese Utility Model Application Publication No. H04-43415

[PTL 3] Japanese Patent No. 5395301

SUMMARY OF INVENTION

Technical Problem

In the above compression drawing method, however, the cylindrical member is placed on a plate that is fixed to a lower die, and the cylindrical member is clamped between the plate and a die that descends from above. That is, thickness is increased through the action of a compressive force on the cylindrical member in a so-called bottomed-out state, and the thickness can therefore be increased. However, it remains difficult to control the increase or decrease in thickness by adjusting the compressive force in response to variations in the thickness of the material metal sheet.

The present invention is contrived in order to solve the above problems, and the object thereof is to provide a formed material manufacturing method in which the inner-diameter roundness of a trunk portion can be maintained with high precision, by controlling increases and decreases in thickness to thereby adjust a peripheral wall thickness of the trunk element before finish-ironing, even when the thickness of the material metal sheet varies or forming die conditions vary.

A further object of the present invention is to provide a formed material manufacturing method in which occurrence of plating film residue can be prevented by forming a clearance of a forming die used in finish-ironing, even in a case where a surface-treated steel sheet resulting from plating of the surface of a steel sheet is used as the material metal sheet.

Solution to Problem

The formed material manufacturing method according to the present invention includes manufacturing a formed material having a cylindrical trunk portion and a flange portion formed at an end section of the trunk portion by performing multi-stage drawing of a material metal sheet, wherein the multi-stage drawing includes: preliminary drawing that forms, from the material metal sheet, a preform having a trunk element; compression drawing that is performed at least once after the preliminary drawing, and that forms the trunk portion by drawing the trunk element while applying, to the trunk element, a compressive force along the depth direction of the trunk element, by using a forming die including a die having a push-in hole, a punch that is inserted into the trunk element and that pushes the trunk element into the push-in hole, and pressing means for applying the compressive force to a peripheral wall of the trunk element; and finish-ironing that is performed at least once after the compression drawing performed at least once, the pressing means is a lifter pad having a pad portion which is disposed at an outer peripheral position of the punch so as to oppose the die and on which a lower end of the peripheral wall of the trunk element is placed, and a support portion configured to support the pad portion from below and to be capable of adjusting a support force with which the pad portion is supported, the compression drawing performed at least once is performed so as to be complete by the time at which the pad portion reaches a bottom dead center, and the support force acts on the trunk element, as the compressive force, during compression drawing of the trunk element.

Advantageous Effects of Invention

In the formed material manufacturing method of the present invention, a trunk portion is formed through drawing of a trunk element while a compressive force according to the thickness of a material metal sheet is applied to the trunk element along the depth direction of the trunk element. Accordingly, insufficient ironing and impairment of inner-diameter roundness during finish-ironing can be avoided by increasing the compressive force, even when the thickness of the material metal sheet varies more than expected towards smaller values. Further, the occurrence of plating residue can be prevented while satisfying the inner-diameter roundness, by decreasing the compressive force, even when, conversely, the thickness of the material metal sheet varies more than expected towards larger values. Accordingly, material metal sheets of wider thickness tolerance than conventional sheets can be used as a result, which makes for easier material procurement.

BRIEF DESCRIPTION OF DRAWINGS

FIG. 11 is an explanatory diagram illustrating a range of moldable material thickness in bottoming wall thickening (Comparative example 2).

FIG. 12 is an explanatory diagram illustrating a range of moldable material thickness in lifter controlled-wall thickening (example of the present invention).

DESCRIPTION OF EMBODIMENT

An embodiment for carrying out the present invention will be explained next with reference to accompanying drawings.

Embodiment 1

Figure 1:
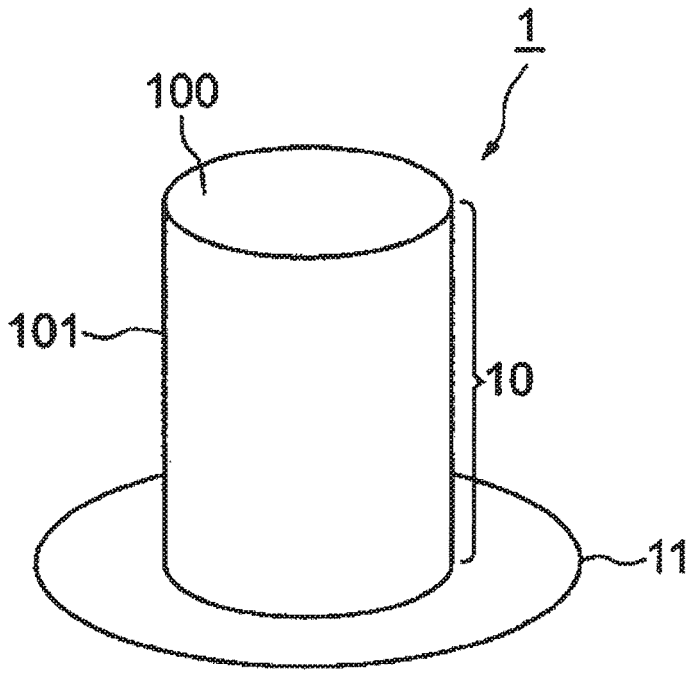
FIG. 1 is a perspective-view diagram illustrating a formed material 1 manufactured in accordance with a formed material manufacturing method of Embodiment 1 of the present invention.

FIG. 1 is a perspective-view diagram illustrating a formed material 1 manufactured in accordance with a formed material manufacturing method of Embodiment 1 of the present invention. As illustrated in FIG. 1, the formed material 1 manufactured in accordance with the formed material manufacturing method of the present invention has a trunk portion 10 and a flange portion 11. The trunk portion 10 is a cylindrical portion having a top wall 100 and a peripheral wall 101 extending from the outer edge of the top wall 100. The top wall 100 may in some instances be referred to under other names, for example as bottom wall, depending on the orientation in which the formed material 1 is used. In FIG. 1, the trunk portion 10 is depicted as having a true circular cross-section, but the trunk portion 10 may have some other cross-sectional shape, for example elliptical or square tubular. For example, the top wall 100 can be further worked through formation of, for example, a protrusion that protrudes from the top wall 100. The flange portion 11 is a plate portion formed at the end section of the trunk portion 10 (end section of the peripheral wall 101).

Figure 2:
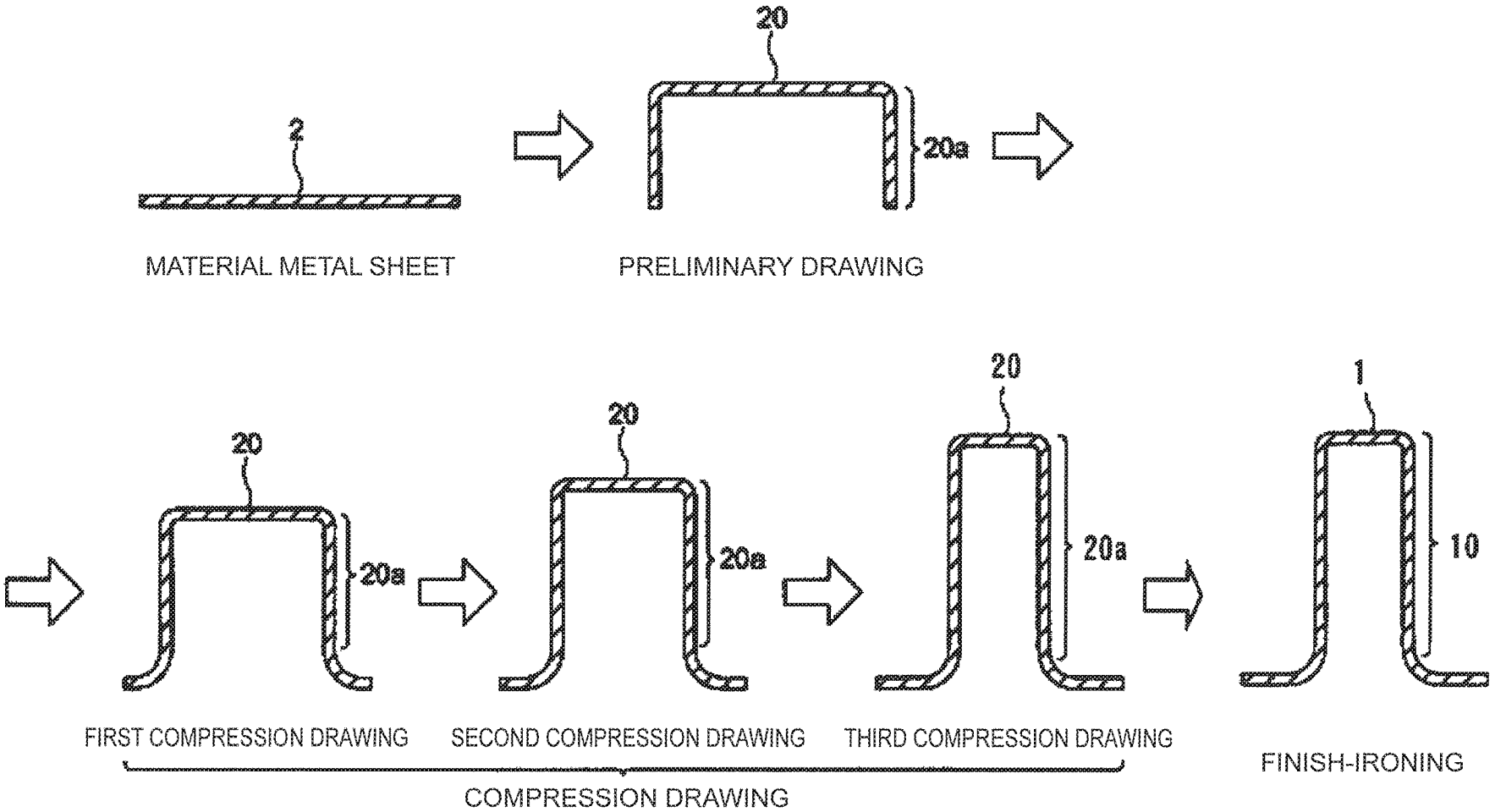
FIG. 2 is an explanatory diagram illustrating a formed material manufacturing method, according to which the formed material of FIG. 1 is manufactured.

FIG. 2 is an explanatory diagram illustrating a formed material manufacturing method, according to which the formed material 1 of FIG. 1 is manufactured. In the formed material manufacturing method of the present invention the formed material 1 is formed by performing multi-stage drawing and finish-ironing of a plate-like material metal sheet 2. Multi-stage drawing encompasses herein preliminary drawing and compression drawing performed at least once after the preliminary drawing. In the formed material manufacturing method of the present embodiment, compression is performed three times (first to third compression operations). Metal sheets of various types of plated steel sheet can be used as the material metal sheet 2.

Preliminary drawing is a step of forming a preform 20 having a trunk element 20*a*, through working of the material metal sheet 2. The trunk element 20*a* is a cylindrical body of larger diameter and smaller depth than those of the trunk portion 10 of FIG. 1. The depth direction of the trunk element 20*a* is defined by the extension direction of the peripheral wall of the trunk element 20*a*. In the present embodiment the entirety of the preform 20 makes up the trunk element 20*a*. However, a body having a flange portion may be formed as the preform 20. In this case the flange portion does not make up the trunk element 20*a*.

As explained in detail further on, the first compression drawing to third compression drawing are steps of forming the trunk portion 10 by drawing the trunk element 20*a* while applying to the trunk element 20*a* a compressive force 42*a* (FIG. 5) along the depth direction of the trunk element 20*a*. Drawing of the trunk element 20*a* denotes herein reducing the diameter of the trunk element 20*a* and increasing the depth of the trunk element 20*a*.

Figure 3:
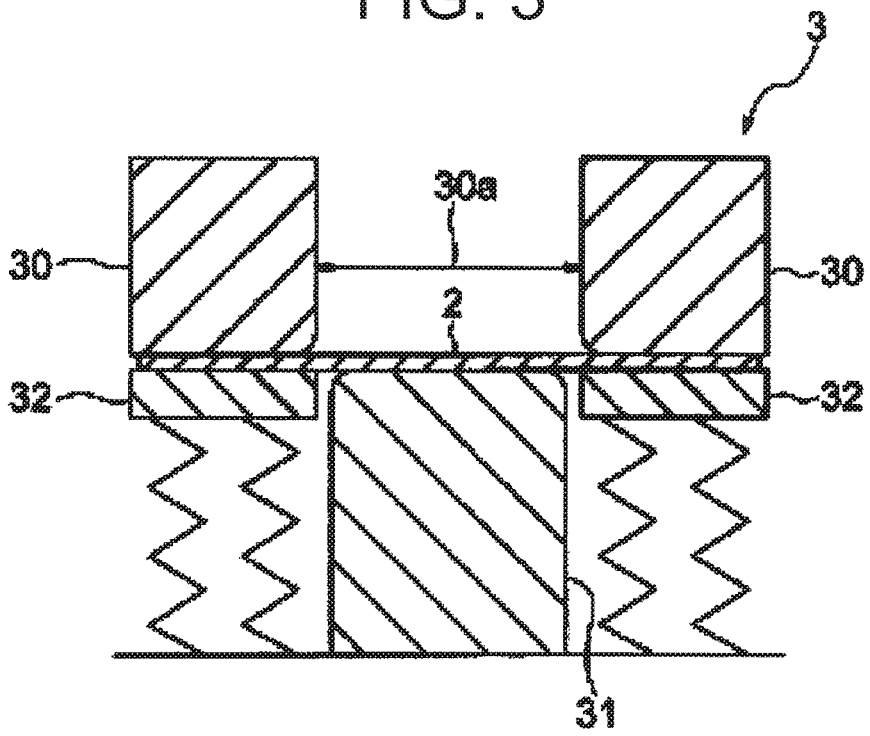
FIG. 3 is an explanatory diagram illustrating a forming die used in preliminary drawing of FIG. 2.
Figure 4:
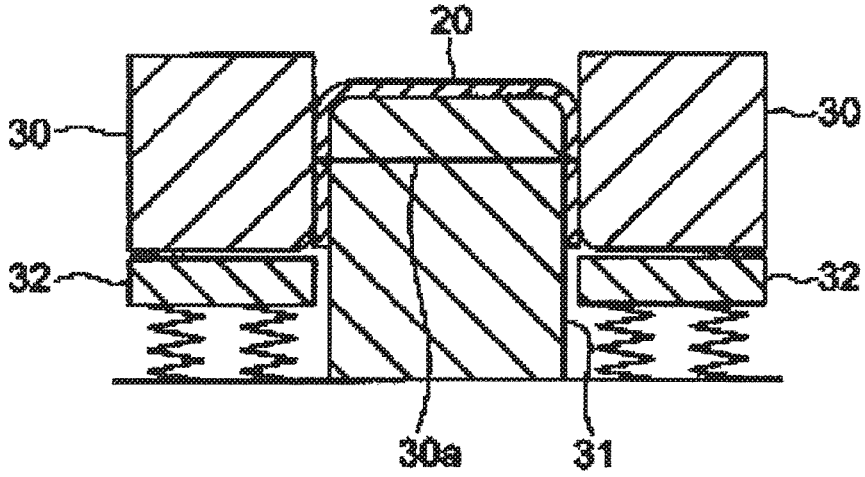
FIG. 4 is an explanatory diagram illustrating preliminary drawing by the forming die of FIG. 3.

Next, FIG. 3 is an explanatory diagram illustrating a forming die 3 used in preliminary drawing of FIG. 2. FIG. 4 is an explanatory diagram illustrating preliminary drawing by the forming die 3 of FIG. 3. As illustrated in FIG. 3, the forming die 3 used in preliminary drawing includes a die 30, a punch 31 and a cushion pad 32. The die 30 is provided with a push-in hole 30*a* through which the material metal sheet 2 is pushed in together with the punch 31. The cushion pad 32 is disposed at an outer peripheral position of the punch 31 so as to oppose an end face of the die 30. Preliminarily, the outer edge portion of the material metal sheet 2 is thrust to the point of coming off the restraint of the die 30 and the cushion pad 32, without the outer edge portion of the material metal sheet 2 being completely restrained by the die 30 and the cushion pad 32, as illustrated in FIG. 4. The entirety of the material metal sheet 2 may be pushed in through the push-in hole 30*a* together with the punch 31. In a case where a preform 20 having a flange portion is to be formed, as described above, it suffices to stop at a depth such that the outer edge portion of the material metal sheet 2 does not come off the restraint of the die 30 and the cushion pad 32.

Figure 5:
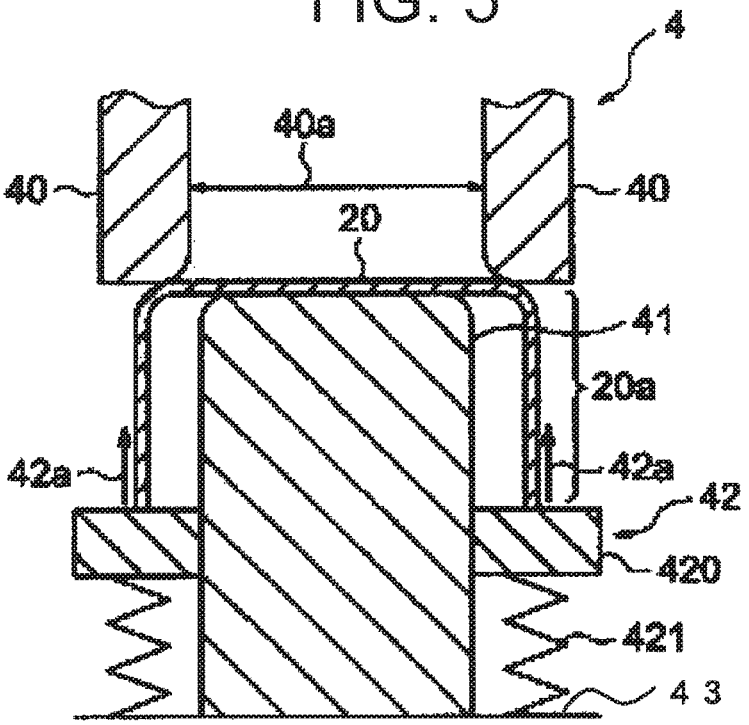
FIG. 5 is an explanatory diagram illustrating a forming die used in first compression drawing of FIG. 2.
Figure 6:
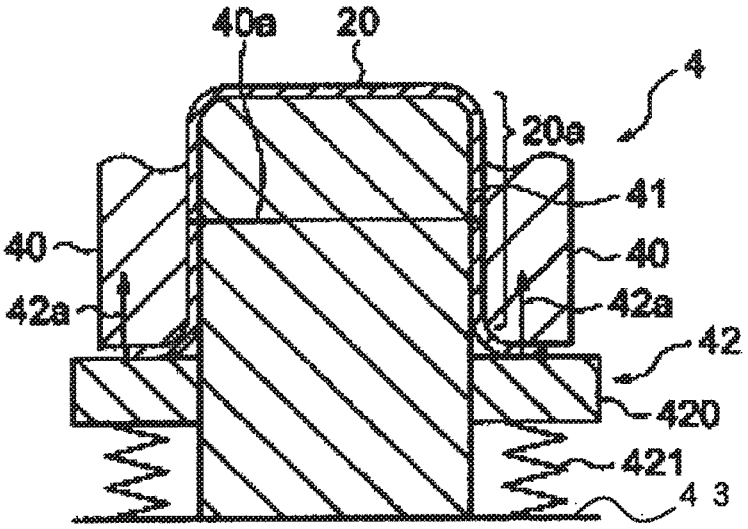
FIG. 6 is an explanatory diagram illustrating the first compression drawing by the forming die of FIG. 5.

Next, FIG. 5 is an explanatory diagram illustrating a forming die 4 used in first compression drawing of FIG. 2. FIG. 6 is an explanatory diagram illustrating the first compression drawing by the forming die 4 of FIG. 5. As illustrated in FIG. 5, the forming die 4 used in the first compression drawing includes a die 40, a punch 41 and a lifter pad 42. The die 40 is a member having a push-in hole 40*a*. The punch 41 is a cylindrical body that is inserted into the trunk element 20*a* and that pushes the trunk element 20*a* into the push-in hole 40*a*.

The lifter pad 42 is disposed at the outer peripheral position of the punch 41 so as to oppose the die 40. Specifically, the lifter pad 42 has a pad portion 420 and an urging portion 421. The pad portion 420 is an annular portion disposed at the outer peripheral position of the punch 41 so as to oppose the die 40. The urging portion 421 is disposed below the pad portion 420, and urges and supports the pad portion 420. The trunk element 20*a* is placed on the pad portion 420. The peripheral wall of the trunk element 20*a* becomes clamped by the die 40 and the pad portion 420 when the die 40 descends. As a result of clamping of the peripheral wall of the trunk element 20*a* by the die 40 and the pad portion 420, the urging force (lifter pad force) of the urging portion 421 is applied to the trunk element 20*a* in the form of the compressive force 42*a* along the depth direction of the trunk element 20*a*. That is, the lifter pad 42 constitutes pressing means for applying, to the trunk element 20*a*, the compressive force 42*a* along the depth direction of the trunk element 20*a*.

As illustrated in FIG. 6, in the first compression drawing the die 40 descends, and as a result the trunk element 20*a* becomes inserted together with the punch 41 into the push-in hole 40*a*, and the trunk element 20*a* is drawn thereby. At this time, the compressive force 42*a* along the depth direction of the trunk element 20*a* continues to be applied to the trunk element 20*a* after the peripheral wall of the trunk element 20*a* has been clamped by the die 40 and the pad portion 420. In the first compression operation, thus, the trunk element 20*a* is drawn while under application of a compressive force 42*a*. As explained in detail further on, the trunk element 20*a* can be drawn without giving rise to wall thinning of the trunk element 20*a*, in a case where the compressive force 42*a* satisfies a predetermined condition. As a result, the thickness of the trunk element 20*a* having undergone the first compression operation becomes equal to or greater than the thickness of the trunk element 20*a* before the first compression drawing.

The lower face of the lifter pad 42 during work is in a state of being capable of moving vertically while not abutting the top face of the punch holder 43. This is a state in which the die 40 having descended during work, without so-called bottoming, and the lifter pad 42 that would move upward on account of the urging force (lifter pad force) of the urging portion 421, are balanced via the trunk element 20*a*.

A structure with bottoming of the lifter pad 42 entails that the urging force (lifter pad force) of the urging portion 421 is smaller than the deformation resistance force at the time of diameter reduction of the trunk element 20*a* by undergoing deformation. In this case, the molding forces between the lowered die 40 and the punch holder 43 via the lifter pad 42 are balanced, and accordingly the greater part of the urging force (lifter pad force) acting on the trunk element 20*a* is only deformation resistance during press-fit into the die 40, through reduction in the diameter of the trunk element 20*a*. Therefore, factors contributing to wall thickening include mainly the forming die clearance between the die 40 and the punch, the die R, and the material strength (proof strength×cross-sectional area) of the trunk element 20*a*, which have a bearing on deformation resistance. Once established, these conditions are not easy to modify, and accordingly it is found that in a compression forming die of bottoming structure it is difficult to control increases and decreases in thickness in response to variations in the thickness of the material metal sheet.

The second and third compression operations in FIG. 2 are carried out using a forming die having a configuration identical to that of the forming die 4 illustrated in FIG. 5 and FIG. 6. The dimensions of the die 40 and of the punch 41 are modified as appropriate. In the second compression operation, thus, the trunk element 20*a* after the first compression operation is drawn while under application of a compressive force 42*a*. In the third compression operation, the trunk element 20*a* after the second compression operation is drawn while the compressive force 42*a* is being applied thereto. The trunk element 20*a* becomes the trunk portion 10 as a result of the first to third compression operations, followed by finish-ironing. In the present invention it is important to adjust the compressive force in the first compression step to third compression step in such a manner that the thickness of the trunk element 20*a* in the third compression step, being the pre-process of finish-ironing, takes on a predetermined thickness value. Finish-ironing is performed as a result with an appropriate forming die clearance such that no plating residue occurs, while satisfying inner-diameter roundness.

Figure 7:
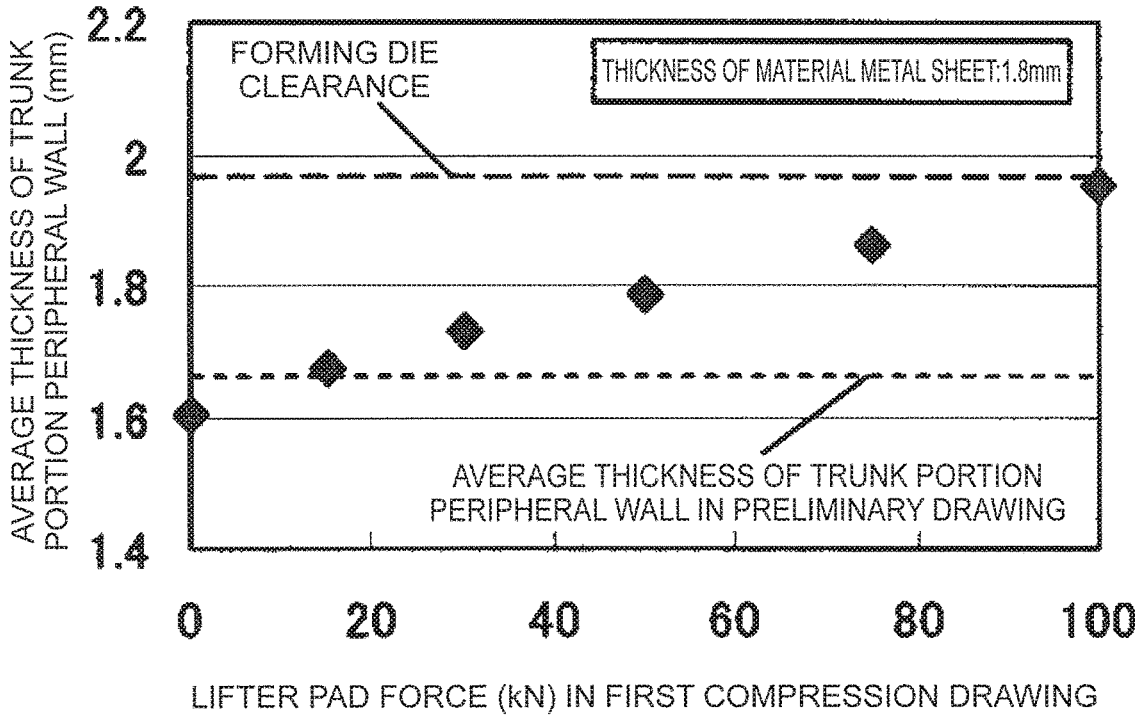
FIG. 7 is a graph illustrating the relationship between lifter pad force and average thickness of a trunk portion peripheral wall in a first compression drawing step.

Examples are illustrated next. The inventors studied the relationship between the size of the lifter pad force at the time of compression and the average thickness of the trunk portion peripheral wall (mm) of the trunk element 20*a*, by using, as the material metal sheet 2, a circular sheet obtained through Zn—Al—Mg plating of a cold-rolled sheet of ordinary steel, the circular sheet having a thickness of 1.60 to 1.95 mm, a plating deposition amount of 90 g/m$^2$, and a diameter of 116 mm. The relationship between a finish-ironing forming die clearance and the inner-diameter roundness after finish-ironing was assessed using trunk elements 20*a* before finish-ironing, with various thicknesses of the peripheral wall of the trunk portion, and having been manufactured by modifying the lifter pad force during the compression step. There were also assessed a range of moldable material thickness for ordinary wall thinning in which no directional compressive force is applied (Comparative example 1), for bottoming wall thickening being conventional compression work (Comparative example 2), and for wall thickening controlled by lifter pad force of the present invention. There was further assessed a relationship between ironing rate and die shoulder radius (mm) in a finish-ironing step, over a moldable range within which inner-diameter roundness after finish-ironing is satisfied and no plating residue is observed to occur. The work conditions are as given below. The results are illustrated in FIG. 7.

Radius of curvature of die shoulder: 0.45 to 10 mm

Punch diameter: preliminary drawing 66 mm, first compression drawing 54 mm, second compression drawing 43 mm, third drawing compression 36 mm, finish-ironing 36 mm Forming die clearance (single side) between die and punch: preliminary drawing 2.00 mm, first compression drawing 1.95 mm, second drawing compression 1.95 mm, third compression drawing 1.95 mm, finish-ironing 1.55 mm Lifter pad force: 0 to 100 kN Press oil: TN-20N FIG. 7 is a graph illustrating the relationship between lifter pad force and average thickness of the trunk portion peripheral wall in a first compression drawing step, using a Zn—Al—Mg plated steel sheet having a thickness of 1.8 mm, as the material metal sheet. In FIG. 7, the vertical axis represents the average thickness of the trunk portion peripheral wall after the first compression drawing, and the horizontal axis represents the lifter pad force (kN) in the first compression drawing. The average thickness of the trunk portion peripheral wall denotes a value resulting from averaging the thickness of the peripheral wall, from a radius curve end of the punch shoulder radius on the flange side up to a radius curve end of the die shoulder radius on the top wall side. It is found that the average thickness of the trunk portion peripheral wall increases substantially linearly as the lifter pad force of the first compression operation increases. It is likewise found that wall thickness becomes greater than the average thickness of the trunk portion peripheral wall at preliminary drawing, by setting the first compression operation lifter pad force to be about 15 kN or more.

Figure 8:
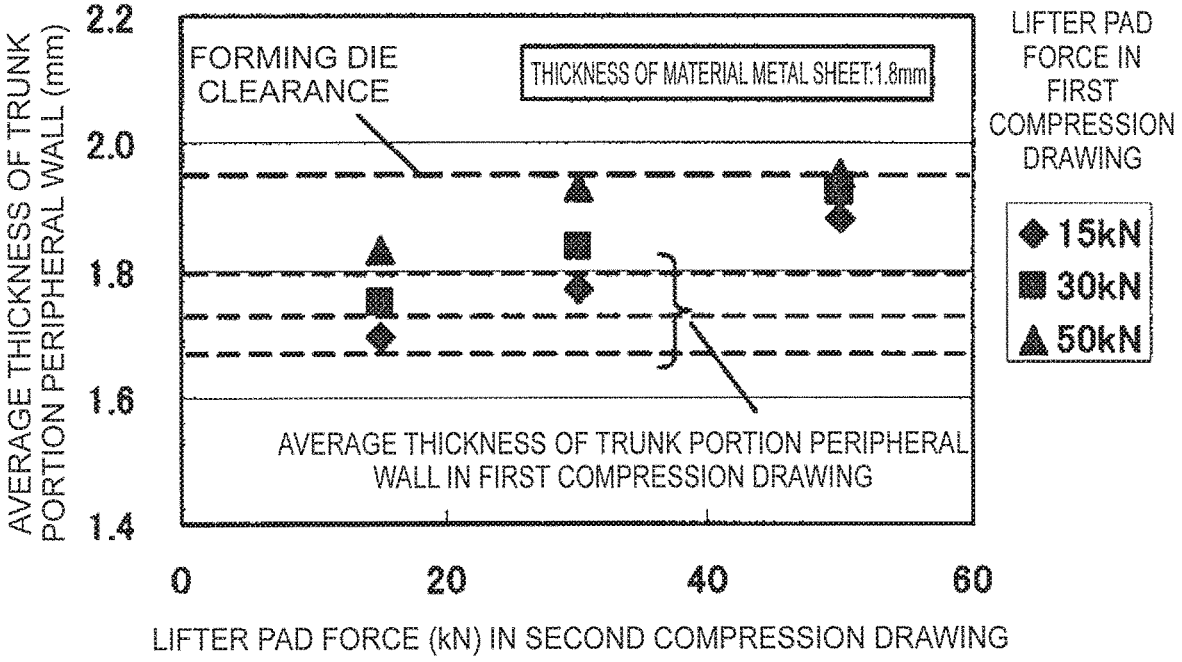
FIG. 8 is a graph illustrating the relationship between lifter pad force and average thickness of a trunk portion peripheral wall in a second compression drawing step.

FIG. 8 is a graph illustrating the relationship between lifter pad force and average thickness of the trunk portion peripheral wall in a second compression drawing step. Herein a Zn—Al—Mg plated steel sheet having a thickness of 1.8 mm was used as the material metal sheet, similarly to FIG. 7. In FIG. 8, the vertical axis represents the average thickness of the trunk portion peripheral wall after second compression drawing, and the horizontal axis represents the lifter pad force (kN) in the second compression drawing. Herein it is found that the average thickness of the trunk portion peripheral wall increases linearly accompanying an increase in the lifter pad force of the second compression drawing, similarly to the first compression drawing step. For a trunk element having been formed with a lifter pad force of 50 kN in the first compression drawing, the thickness was increased to a thickness substantially identical to the forming die clearance with a lifter pad force of the second compression drawing of about 30 kN, and the thickness kept constant even the lifter pad force was increased beyond the above value. This reveals that, by adjusting (increasing) the lifter pad force, the thickness of the trunk element can be increased up to a thickness similar to the forming die clearance. It is found that setting the lifter pad force to about 10 kN or more in the second compression drawing results in a thicker wall than the average thickness of the trunk portion peripheral wall in the first compression drawing step.

Figures 9, 10:
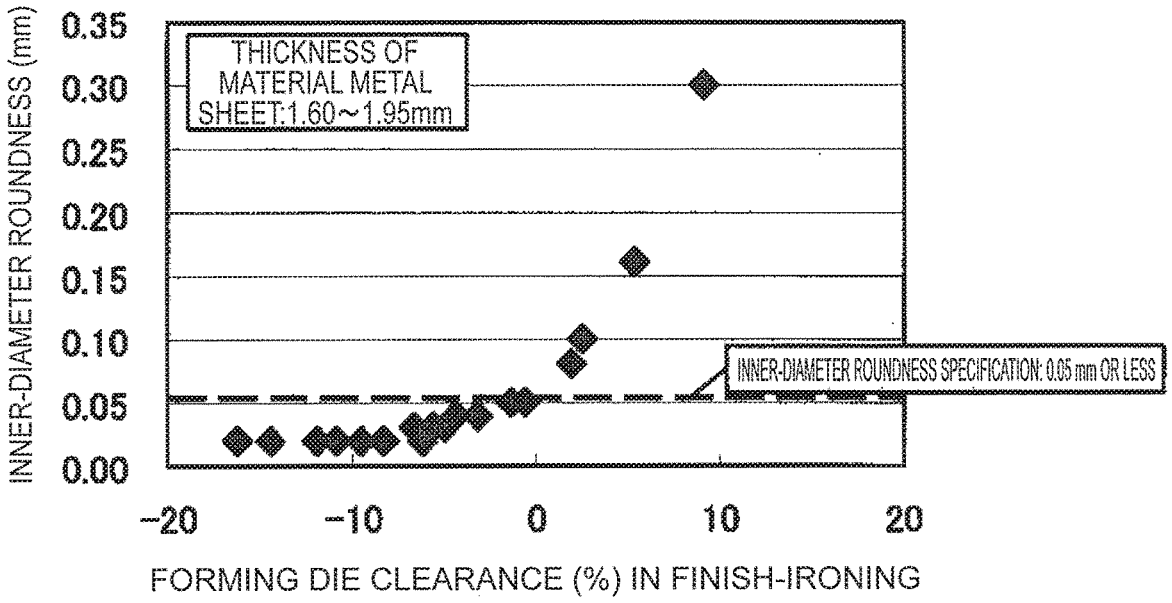
FIG. 9 is a graph illustrating the relationship between forming die clearance in finish-ironing and inner-diameter roundness of a trunk portion peripheral wall after finish-ironing.
FIG. 10 is an explanatory diagram illustrating a range of moldable material thickness in ordinary wall thinning (Comparative example 1).

FIG. 9 is a graph illustrating the relationship between forming die clearance in a finish-ironing step and inner-diameter roundness of the trunk portion peripheral wall after finish-ironing. Herein Zn—Al—Mg plated steel sheets having a thickness of 1.60 to 1.95 mm were used as the material metal sheet. In FIG. 9 the vertical axis represents the inner-diameter roundness (mm) after finish-ironing and the horizontal axis represents finish-ironing forming die clearance. The finish-ironing forming die clearance is as follows.

$$\text{Finish-ironing forming rate}=\{(C_{re}-t_{re})/t_{re}\}\times 100$$

where $C_{re}$: finish-ironing forming die clearance $t_{re}$: average thickness of the peripheral wall of the trunk element before finish-ironing It is found that the inner-diameter roundness increases sharply as the finish-ironing forming die clearance becomes larger. It was further found that an inner-diameter roundness specification of 0.05 mm or less can be satisfied at a region where the finish-ironing forming die clearance is negative i.e. by performing ironing of reducing the thickness of the trunk element.

FIG. 10 sets out experimental results of a range of moldable material thickness in ordinary wall thinning (Comparative example 1). FIG. 11 sets out experimental results of a range of moldable material thickness in bottoming wall thickening (Comparative example 2), being a conventional wall thickening compression method. FIG. 12 sets out experimental results of a range of moldable material thickness in lifter controlled-wall thickening (example of the present invention). The figures illustrate thickness before finish-ironing, finish-ironing clearance, as well as inner-diameter roundness of the trunk portion peripheral wall after finish-ironing, and occurrence of plating residue after finish-ironing, versus the thickness of the material metal sheets used in the experiments, and illustrate also evaluation results based on the inner-diameter roundness and occurrence of plating residue. Whether or not lifter pad force is exerted at the time of the first compression drawing is notated for reference only in FIG. 12, which depicts lifter controlled-wall thickening (example of the present invention).

No compressive force was applied to the trunk element in ordinary wall thinning of Comparative example 1 illustrated in FIG. 10, and accordingly thickness before finish-ironing decreased uniformly with respect to the thickness of the material metal sheet.

For a thickness of 1.60 to 1.75 mm of the material metal sheet, the clearance in the finish-ironing step was positive, and accordingly the inner-diameter roundness exceeded a specification 0.05 mm, without ironing. For a thickness of 1.95 mm of the material metal sheet, the clearance in the finish-ironing step was −10.9%, and thus the inner-diameter roundness after finish-ironing was satisfied, but plating residue was found to occur from sites of sliding against the die, in the finish-ironing step. As a result, the moldable material thickness in ordinary wall thinning (Comparative example 1) lay in the range of 1.75 mm to 1.90 mm, having a width of 0.15 mm.

In bottoming wall thickening of Comparative example 2 illustrated in FIG. 11, a compressive force was applied to the trunk element, and accordingly although the thickness before finish-ironing decreased uniformly with respect to the thickness of the material metal sheet, the extent of the decrement was smaller than in Comparative example 1 (ordinary wall thinning).

The inner-diameter roundness exceeded a specification 0.05 mm only for a thickness of 1.60 mm of the material metal sheet. Plating residue was found to occur from sites of sliding against the die, in the finish-ironing step, in cases where the thickness of the material metal sheet was 1.85 mm or greater.

In the above results, the moldable material thickness in bottoming wall thickening (Comparative example 2) was 1.65 mm to 1.80 mm, with a width of 0.15 mm. It is found that although the moldable material thickness shifts towards the thin side, as compared with the ordinary wall thinning in Comparative example 1, the width exhibits no change. This signifies that the molding margin in the case of variation of the thickness of the material metal sheet is identical for both ordinary wall thinning (Comparative example 1) and bottoming wall thickening (Comparative example 2).

In wall thickening controlled by lifter pad force of the example of the present invention illustrated in FIG. 12, the compressive force applied to the trunk element can be controlled freely on the basis of the lifter pad force, in accordance with the thickness of the material metal sheet. In consequence, it becomes possible to reduce the variation range in thickness during a finish-ironing pre-process. For example as illustrated in FIG. 12, the variation range of thickness before finish-ironing can be reduced by performing compression drawing by wall thickening through application of a lifter pad force during the first compression drawing, for a small thickness, of 1.60 mm to 1.75 mm, of the material metal sheet, and through wall thinning without application of a lifter pad force, for a large thickness, of 1.80 mm or greater, of the material metal sheet. The condition of no lifter pad force being exerted corresponds to ordinary wall thinning in Comparative example 1. Plating residue was found to occur from sites of sliding against the die, in the finish-ironing step, in cases where the thickness of the material metal sheet was 1.95 mm, but roundness after finish-ironing satisfied a specification of 0.05 mm or less regardless of the thickness of the material metal sheet. In these results, the moldable material thickness in wall thickening controlled by lifter pad force (the present invention) lay thus in the range of 1.60 mm to 1.90 mm, with a range width of 0.30 mm. This indicates that in wall thickening controlled by lifter pad force of the example of the present invention the molding margin in case of variations in the thickness of the material metal sheet is wider than in ordinary wall thinning (Comparative example 1) and in bottoming wall thickening (Comparative example 2). That is, the range of the thickness of the material metal sheet over which molding is possible is wider in the formed material manufacturing method of the present invention than in ordinary wall thinning of Comparative example 1 and than in bottoming wall-thickening, being a conventional wall thickening compression method, of Comparative example 2.

Figure 13:
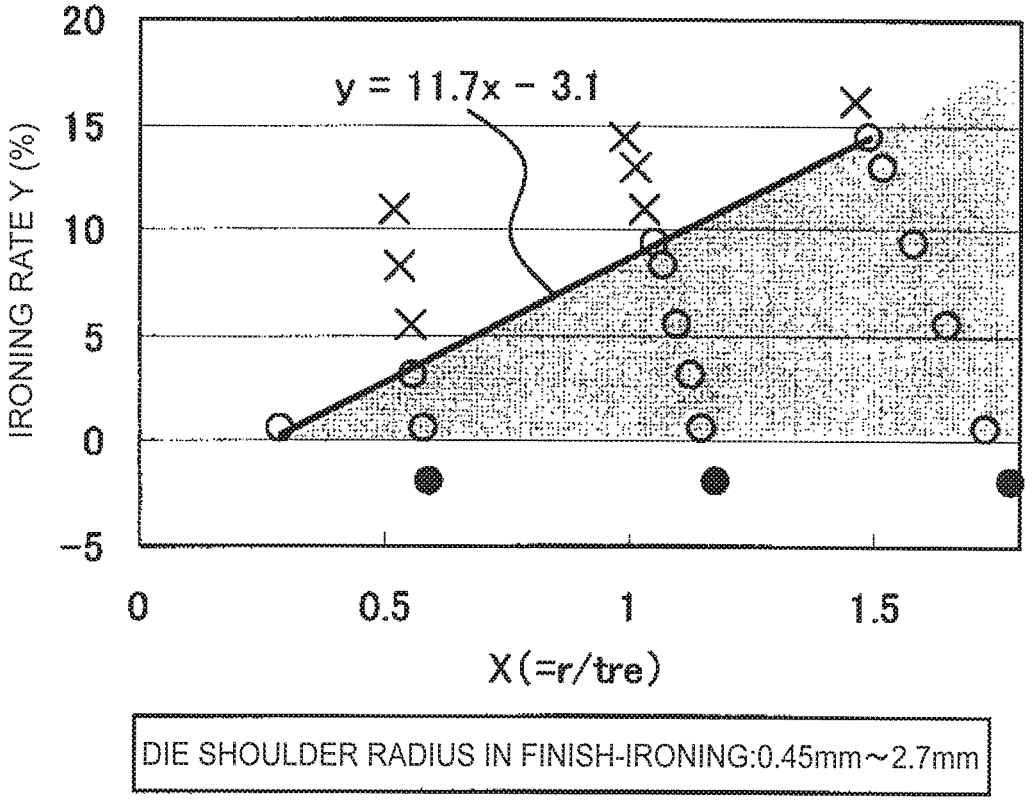
FIG. 13 is a graph illustrating the relationship between ironing rate Y and X (=r/tre) in a Zn—Al—Mg-based alloy plated steel sheet.
Figure 14:
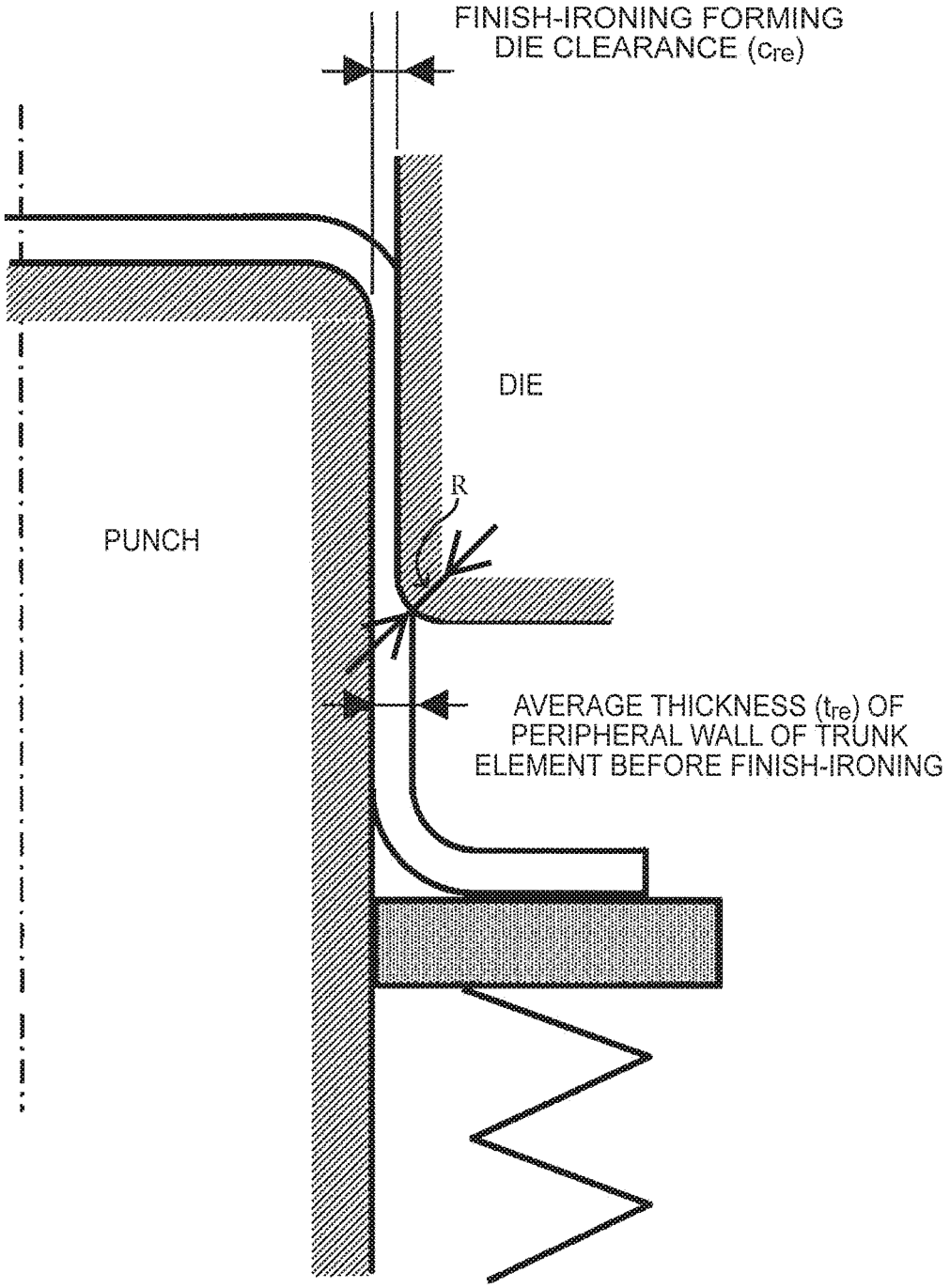
FIG. 14 is an explanatory diagram illustrating the relationship between the average thickness $t_{re}$ of the peripheral wall of a trunk element before finish-ironing and the clearance $c_{re}$ of a finish-ironing forming die, in finish-ironing.

FIG. 13 is a graph illustrating the relationship between ironing rate Y and X (=r/tre) in a case where a Zn—Al—Mg-based alloy plated steel sheet is used as a material metal sheet. In FIG. 13 the vertical axis represents the ironing rate Y and the horizontal axis represents a ratio X of the radius of curvature r of the die shoulder of a finish-ironing forming die and the average thickness tre of the peripheral wall of the trunk element before finish-ironing.

The ironing rate Y is defined as follows.

$$Y(\%)=\{(t_{re}-c_{re})/t_{re}\}\times\square 100$$

where, $c_{re}$: finish-ironing forming die clearance $t_{re}$: average thickness of the peripheral wall of the trunk element before finish-ironing In the figure, the white circles (○) denote an evaluation rating to the effect that occurrence of plating residue can be suppressed, while the crosses (x) denote a rating to the effect that occurrence of plating residue cannot be suppressed. Further, the black circles (•) indicate that inner-diameter roundness exceeds 0.05 mm. As illustrated in FIG. 13, it was found that in the case of a Zn—Al—Mg-based alloy plated steel sheet it was possible to suppress occurrence of plating residue in a region below the straight line represented by Y=11.7X−3.1. That is, it was found that occurrence of plating residue can be suppressed by establishing the average thickness $t_{re}$ of the peripheral wall of the trunk element before finish-ironing so as to satisfy $0<Y\leq 11.7X-3.1$, as a result of wall thickening controlled by lifter pad force. The term $0<Y$ prescribed in the above conditional expression derives from the fact that no ironing is performed in a case where the ironing rate Y is not higher than 0%.

In this formed material manufacturing method, a trunk portion is formed through drawing of a trunk element while a compressive force according to the thickness of a material metal sheet is applied to the trunk element along the depth direction of the trunk element. Accordingly, insufficient ironing and impairment of internal precision during finish-ironing can be avoided by increasing the lifter pad force, even when the thickness of the material metal sheet varies towards smaller values than in conventional instances. Further, the inner-diameter roundness can be satisfied while preventing occurrence of plating residue by decreasing the lifter pad force, even when, conversely, the thickness of the material metal sheet varies towards larger values than in conventional instances. In consequence, material metal sheets of wider thickness tolerance than conventional ones can be used as a result, which makes for easier material procurement.

The present configuration is particularly useful in applications where a formed material such as a motor case is required to exhibit high-precision inner-diameter roundness.

The lifter pad 42, which does not bottom out during work, constitutes pressing means, and hence it becomes possible to draw the trunk element 20*a* more reliably while applying to the trunk element 20*a* the compressive force 42*a* along the depth direction of the trunk element 20*a*.

The lifter pad force in the compression drawing step can be adjusted in accordance with the thickness of the material metal sheet, and accordingly the average thickness of the peripheral wall of the trunk element before finish-ironing can be kept within a proper thickness range, regardless of the thickness of the material metal sheet, and stable ironing can be performed with a constant ironing clearance at all times.

Further, the formed material manufacturing method of the present invention satisfies $0<Y\leq 11.7X-3.1$, where Y denotes the ironing rate and X denotes the ratio of the radius of curvature r of the die shoulder of the finish-ironing forming die to the average thickness $t_{re}$ of the peripheral wall of the trunk element before finish-ironing; as a result, the inner-diameter roundness after finish-ironing can be satisfied, and the trunk element 20*a* can be drawn without giving rise to plating residue.

In the explanation of the embodiment compression is carried out three times, but the number of compression operations may be modified as appropriate depending on the size and the required dimensional precision of the formed material 1.

The invention claimed is:

1. A formed material manufacturing method, comprising manufacturing a formed material having a cylindrical trunk portion and a flange portion formed at an end section of the trunk portion by performing multi-stage drawing of a material metal sheet, wherein the multi-stage drawing includes:

preliminary drawing that forms, from the material metal sheet, a preform having a trunk element, wherein the trunk element comprises a top wall and a peripheral wall;

compression drawing that is performed at least once after the preliminary drawing and that forms the trunk portion by drawing the trunk element while applying, to the trunk element, a compressive force along a depth direction of the trunk element, by using a forming die including a die having a push-in hole, a punch that is inserted into the trunk element and that pushes the trunk element into the push-in hole, and pressing means for applying the compressive force to the peripheral wall of the trunk element extending along the depth direction of the trunk element, wherein the trunk portion that is formed by the compression drawing comprises a top wall and a peripheral wall; and finish-ironing that is performed at least once after the compression drawing is performed at least once, the pressing means is a lifter pad having a pad portion which is disposed at an outer peripheral position of the punch so as to oppose the die and on which a lower end of the peripheral wall of the trunk element is placed, and a support portion configured to support the pad portion from below and to be capable of adjusting a support force with which the pad portion is supported, the compression drawing performed at least once is performed so as to be complete by the time at which the pad portion reaches a bottom dead center, and the support force acts on the trunk element, as the compressive force, during compression drawing of the trunk element, wherein, the compression drawing performed at least once comprises adjusting an average thickness of the peripheral wall of the trunk element by adjusting the support force with which the pad portion is supported, in accordance with a thickness of the material metal sheet, wherein the flange portion is formed during the compression drawing.

2. The formed material manufacturing method according to claim 1, wherein, in the finish-ironing performed at least once, a clearance $c_{re}$ of a forming die is established so as to satisfy the relationship given by Expression (1) below, where X denotes a ratio of a radius of curvature r of a die shoulder of the forming die used in the finish-ironing to an average thickness tre of the peripheral wall of the trunk portion before the finish-ironing, and Y denotes an ironing rate represented by $\{(t_{re}-c_{re})/t_{re}\}\times 100$:

$$0<Y\leq 11.7X-3.1 \qquad \text{Expression (1).}$$

3. The formed material manufacturing method according to claim 1, wherein the material metal sheet is a Zn-based plated steel sheet obtained by performing Zn-based plating on a surface of a steel sheet prior to the multi-stage drawing.

* * * * *